US005192421A

United States Patent [19]

Audeh et al.

[11] Patent Number: 5,192,421

[45] Date of Patent: Mar. 9, 1993

[54] INTEGRATED PROCESS FOR WHOLE CRUDE DEASPHALTING AND ASPHALTENE UPGRADING

[75] Inventors: Costandi A. Audeh; Lillian A. Rankel, both of Princeton, N.J.

[73] Assignee: Mobil Oil Corporation, Fairfax, Va.

[21] Appl. No.: 685,758

[22] Filed: Apr. 16, 1991

[51] Int. Cl.[5] ..... C10C 3/00; C10G 7/00; B01D 3/00

[52] U.S. Cl. ..... 208/309; 208/86; 208/92; 208/347; 208/41

[58] Field of Search ..... 208/309, 41, 347, 86, 208/92

[56] References Cited

U.S. PATENT DOCUMENTS

| | | | |
|---|---|---|---|
| 3,637,483 | 1/1972 | Carey | 208/86 |
| 3,975,396 | 8/1976 | Bushnell et al. | 208/309 |
| 4,454,023 | 6/1984 | Lutz | 208/96 |

OTHER PUBLICATIONS

*Metal Complexes in Fossil Fuels,* R. H. Filby and Jan Branthauer, eds., 1986, pp. 220 and 222.

*The Role of Trace Metals in Petroleum,* T. F. Yen, "Chemical Aspects", pp. 23 & 25.

"Degradation of Metalloporphyrins in Heavy Oils Before and During Processing", Lillian Rankel, 1987, American Chemical Society, pp. 257-264.

*Primary Examiner*—Theodore Morris
*Assistant Examiner*—P. L. Hailey
*Attorney, Agent, or Firm*—Alexander J. McKillop; Malcolm D. Keen; Richard D. Stone

[57] ABSTRACT

Deasphalting heavy, asphaltic crudes before significant thermal treatment, even mild treatment which is inherent in, e.g., vacuum distillation, produces deasphalted whole crude with a reduced soluble metal content. This process is especially effective for preparing feedstocks for catalytic cracking units from heavy crudes containing large amounts of Ni and V which are porphyrin coordinated, and which are thermally unstable.

11 Claims, 1 Drawing Sheet

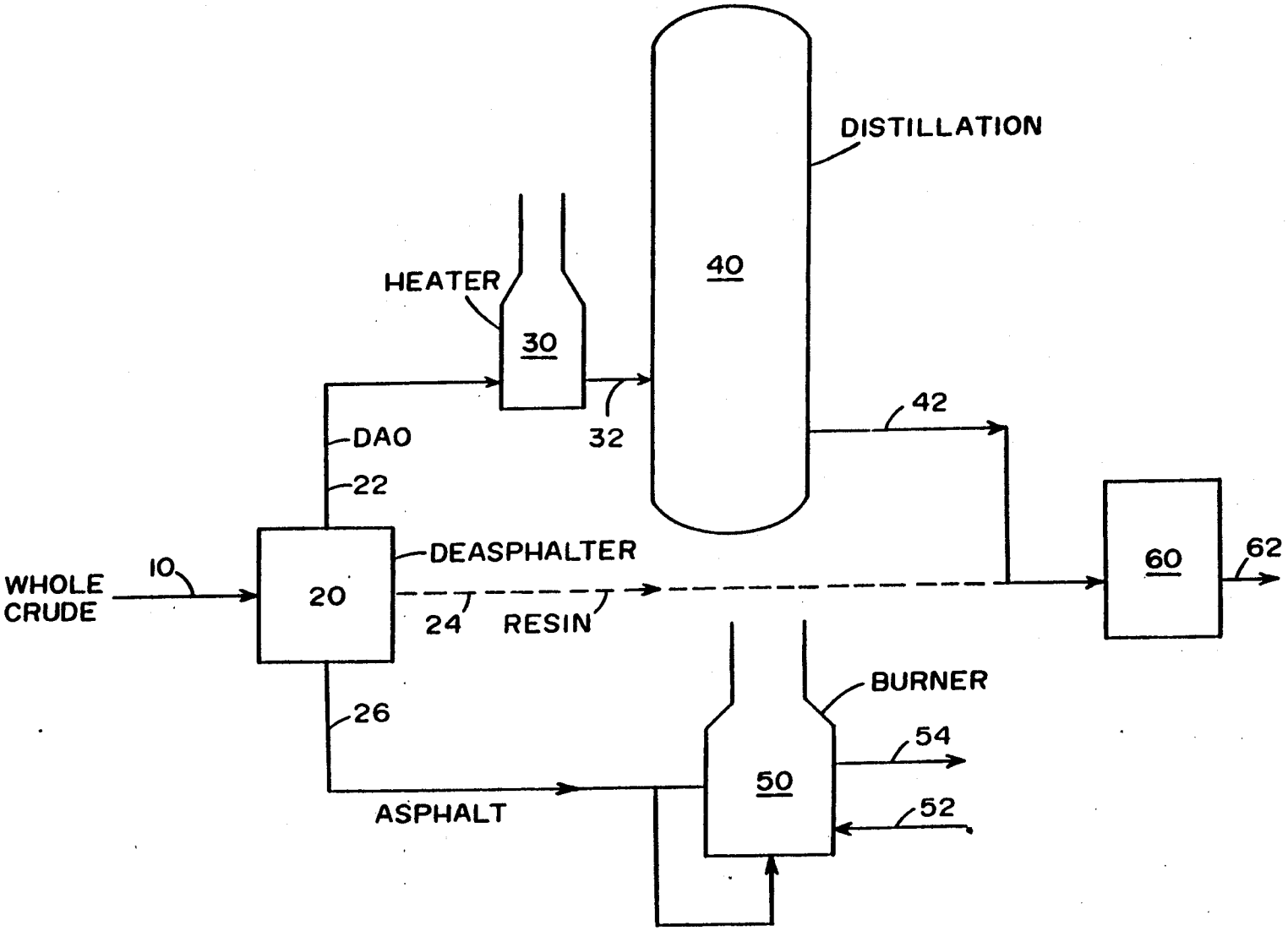
WHOLE CRUDE
10
20
DAO
22
DEASPHALTER
24
RESIN
26
ASPHALT
HEATER
30
32
DISTILLATION
40
42
60
62
BURNER
50
54
52

INTEGRATED PROCESS FOR WHOLE CRUDE DEASPHALTING AND ASPHALTENE UPGRADING

BACKGROUND OF THE INVENTION

1. Field of the Invention

This invention is concerned with upgrading heavy crude oil. It is particularly concerned with deasphalting whole crude, before any high temperature thermal processing, to produce a deasphalted crude with a reduced metals content.

2. Description of the Prior Art

The world's supply of light, sweet crudes has greatly diminished in recent years. Refiners have been forced to deal with ever heavier crudes, containing significantly more metals, while still producing a full spectrum of products. Much of the problem of upgrading these heavier stocks is due to the presence of so much metal, usually nickel and vanadium. The presence of large amounts of metal, usually in association with asphaltenes, presents a formidable upgrading challenge. Some of the worst of these materials are "heavy crudes" while almost as bad are somewhat lighter crudes which contain less asphalt, but even more metal Each type of resource will be briefly reviewed.

HEAVY CRUDES

Extensive reserves of petroleum in the form of so-called "heavy crudes" exist in a number of countries, including Western Canada, Venezuela, Russia, the United States and elsewhere. Many of these reserves are located in relatively inaccessible geographic regions. The United Nations Institute For Training And Research (UNITAR) has defined heavy crudes as those having an API gravity of less than 20, suggesting a high content of polynuclear compounds and a relatively low hydrogen content. The term "heavy crude", whenever used in this specification, means a crude having an API gravity of less than 20. In addition to a high specific gravity, heavy crudes in general have other properties in common, including a high content of metals, nitrogen, sulfur and oxygen, and a high Conradson Carbon Residue (CCR). The heavy crudes generally are not fluid at ambient temperatures and do not meet local specifications for pipelineability. It has been proposed that such crudes resulted from microbic action which consumed alkanes, leaving behind the heavier, more complex structures which are now present.

A typical heavy crude oil is that recovered from the tar sands deposits in the Cold Lake region of Alberta in northwestern Canada. The composition and boiling range properties of a Cold Lake crude (as given by V.N. Venketesan and W.R. Shu, J. Canad. Petr. Tech., page 66, July-August 1986) is shown in Table A.

HIGH METAL CONTENT CRUDES

Although considerably lighter than the "heavy crudes " the high metal content crudes, such as the Mayan, present similar processing hurdles. The high metals crudes are those which are difficult to process by conventional catalytic methods, such that at least the highest boiling portions of these crudes are thermally upgraded by coking or visbreaking. Generally the heaviest fractions, which contain most of the metal, are separated from the lighter fractions by fractionation or vacuum fractionation, to recover a gas oil or vacuum gas oil and lighter fractions which, with difficulty, can be upgraded catalytically.

Unfortunately, the lighter fractions obtained from high metals crudes still contains large amounts of metals. Although the gas oil and vacuum gas oil fractions can be upgraded in, e.g., an FCC, the metals content of such gas oils is so high that some form of metals passivation, or hydrotreating of the feed to remove metals, is usually necessary.

The process of the present invention is directed at upgrading these difficult to treat resources. The most unifying concept of the heavy feeds contemplated for use herein is the asphaltic nature of the crudes, and the fact that they contain such large amounts of materials which are difficult to fractionate without resort to vacuum fractionation. In general, a majority of the whole crude will boil above 900 F, and frequently a majority by weight will boil above 950 F, 1000 F, 1050 F or even higher temperatures.

The metals rich crudes contemplated for use herein will usually contain more than 5 wt % Conradson Carbon Residue (CCR), and frequently will contain more than 10 wt % CCR, and even in excess of 15 wt % CCR, on a whole crude basis.

These heavy oils contain fairly large amounts of metal, typically more than 5 wt ppm Ni, and many times more than 7.5 ppm Ni, and even in excess of 10 ppm Ni, on a whole crude basis. Vanadium is also usually present in large amounts, typically in excess of 25 wt ppm, and with many having more than 40 wt ppm V, and some in excess of 50 wt ppm V, on a whole crude basis.

Maya crude usually contains more more than 10 wt % CCR, and in excess of 50 ppm Ni and more than 250 ppm V. Cold Lake crudes contain similar amounts of CCR, and even more Ni, though somewhat less V, typically around 150-200 ppm V.

Much of the metals content of the crude is associated with the asphaltic fraction. Asphaltics are difficult to characterize because they are not defined by a discrete set of compounds, but rather by the behavior of these compounds in various solvents.

We studied these materials extensively, and realized that not only were these complex materials hard to characterize, they were unstable. Metallo-porphyrins and petroporphyrins can react at high temperatures with $H_2S$ and $H_2$. Extensive experiments were done with heavy metallo-porphyrins and porphyrin model compounds at high temperatures in the presence of $H_2$ and/or $H_2S$ in laboratory experiments conducted over periods ranging from 1-7 days, and based on some fixed bed experiments at LHSVs ranging from 0.3 to 0.505. See reactions of metallo-porphyrins and petroporphyrins with $H_2S$ and $H_2$ L.A. Rankel preprint, *Petr. Div. Am. Chem. Soc.*, Vol. 26, 689-698, August 1981.

Although the complexity and thermal reactivity of metalloporphyrins are generally known, but no one has used this knowledge to devise a better way to process these heavy, metals rich crudes. The magnitude of the problem can be best appreciated by considering some representative high metals crudes. A heavy oil (a Cold Lake crude, Lower Grand Rapids) and a topped Mexican heavy crude (Mayan 650 F +Primary Production) are shown below. The similarities are evident.

TABLE A

| PROPERTIES OF 650° F. FRACTIONS | | |
|---|---|---|
| | Mayan | Cold Lake |
| % C | 84.0 | 83.8 |

TABLE A-continued

| PROPERTIES OF 650° F. FRACTIONS | Mayan | Cold Lake |
|---|---|---|
| H | 10.4 | 10.3 |
| N | 0.06 | 0.44 |
| O | 0.97 | 0.81 |
| S | 4.7 | 4.65 |
| CCR | 17.3 | 12.3 |
| % C7-Insoluble | 18.5 | 15.0 |
| Ni, ppm | 78 | 74 |
| V, ppm | 372 | 175 |
| Boiling Range: | | |
| 75–400 F. | 0.62 | 1.3 |
| 400–800 F. | 21.7 | |
| 400–650 F. | | 15.2 |
| 800–1050 F. | 19.0 | |
| 650–1000 F. | | 29.7 |
| 1050 F.+ | 58.71 | |
| 1000 F.+ | | 53.8 |

Cold Lake crude does not meet local (Canadian) pipeline specifications. This crude is a solid at 38 C (100 F). It is difficult to upgrade locally, at the production site, because of the high metals and CCR values.

The progressive depletion and rising cost of high quality crudes has created a need for a way to inexpensively convert heavy crudes to pipelineable syncrudes, preferably in a way that will not make downstream processing steps more difficult. Such technology would augment the supply of available crude, and would make it possible for refiners to blend such syncrude with a more conventional feed for catalytic cracking and hydrocracking.

A number of methods have been proposed for decreasing the viscosity of a heavy crude oil to improve its pumpability. These include diluting with a light hydrocarbon stream, transport by heated pipeline, and using various processing options including fractionation, visbreaking, coking and deasphalting. With most heavy crudes, conventional visbreaking or conventional deasphalting alone cannot give sufficient viscosity reduction. Fractionation, to concentrate the lighter portions of the whole crude are somewhat effective, but the fractionation itself changes the crude, causing metals to migrate into lighter fractions of the crude. The gas oil or vacuum gas oil fractions obtained by fractionation are believed to be more contaminated with metal than can be accounted for by assuming that all, or almost all, of the metals are associated with the asphaltic residual portion of the crude. We wondered if part of the problem was due to the way the crude is typically processed before deasphalting.

In practice, the whole crude is subjected to one, and usually several stages of distillation at increasingly higher temperatures to recover lighter components. In theory, the metals in the feed should remain in the bottoms or residual fractions with the overhead fractions having much reduced metals content. In practice, this is not the case. The problem is most noticeable when attempts are made to catalytically deasphalt gas oils or vacuum gas oils derived from heavy crudes.

We have now discovered a way to improve the demetallation efficiency of deasphalting processes. We can significantly decrease the metal content of gas oil and vacuum gas oil fractions, and consequently improve the efficiency of downstream catalytic processes which upgrade these fractions by reversing some of the conventional processing step for these heavy, metals containing crudes.

We discovered that reversing conventional processing steps, and deasphalting before fractionation or any severe thermal treatment of the crude, produced lower metal gas oil and vacuum gas oil product fractions than the reverse processing sequence.

BRIEF SUMMARY OF THE INVENTION

Accordingly, the present invention provides a process for recovering distilled hydrocarbon product from an asphaltic crude comprising at least 40 volume % nondistillable residue at conventional distillation conditions including a temperature and a residence time and containing thermally unstable, high boiling, metal containing compounds having a boiling range or solubility such that at least a majority of said unstable metal containing compounds are present in said non-distillable residue and wherein the temperature and residence time of conventional distillation are sufficient to thermally convert said unstable metal compounds to stable metal containing compounds having a lower boiling range or increased solubility in distilled hydrocarbons, characterized by deasphalting the asphaltic crude in a deasphalting means to produce a deasphalted oil with a reduced asphalt content relative to the feed and heating the deasphalted crude to temperature in excess of 500° F. in a downstream refinery process.

In another embodiment, the present invention provides a process for preparing, by distillation from an asphaltic whole crude, in a conventional crude distillation means operating at conventional crude oil distillation conditions including a distillation temperature and distillation residence time to produce a Fluidized Catalytic Cracking (FCC) unit feed comprising gas oil and/or vacuum oil fractions, said crude containing at least 50 volume % nondistillable residue at conventional distillation conditions and having more than 20 ppm nickel and 20 ppm vanadium present in the form of thermally unstable, high boiling, Ni and V containing compounds having a boiling range or solubility such that at least a majority of said unstable Ni and V containing compounds are present in said non-distillable residue fraction and wherein said temperature and residence time of conventional distillation are sufficient to thermally convert said unstable Ni and V compounds to stable Ni and V containing compounds having a lower boiling range or an increased solubility in distilled hydrocarbons, characterized by deasphalting the asphaltic crude in a deasphalting means to produce a deasphalted crude having a reduced asphaltic content and less than 50% of the thermally unstable Ni and V compounds; and distilling the deasphalted crude to produce at least one hydrocarbon fraction selected from the group of gas oil and vacuum gas oil boiling range hydrocarbons to produce a feed for an FCC unit.

In a more limited embodiment the present invention provides in a process for preparing a deasphalted oil charge for a catalytic cracking unit by distilling an asphaltic crude to produce a residuum fraction with an increased asphalt content, deasphalting of the residuum fraction to produce a deasphalted residuum fraction, the improvement comprising deasphalting the asphaltic crude prior to distillation to produce a deasphalted whole crude having gas oil and a vacuum gas oil boiling range fractions and fractionating said deasphalted oil charge to produce a gas oil or vacuum gas oil boiling range fraction for use as feed to a catalytic cracking unit.

BRIEF DESCRIPTION OF THE DRAWING

The Figure is a simplified process flowsheet of a preferred embodiment.

DETAILED DESCRIPTION

The present invention requires an unusual crude chargestock, one severely contaminated with metals and which contains large amounts of asphaltics and/or non-distillables. This heavy crude is deasphalted before, rather than after, any thermal processing step which would break down metalloporphyrins and make them more soluble in the lighter fractions of the crude. Even conventional distillation of these heavy crude materials can be too much thermal treatment. The crude feedstocks, deasphalting, thermal treatments to be avoided, and product properties will each be reviewed in greater detail after an overview of the process presented in conjunction with a review of the Figure.

The Figure is a simplified flow diagram, and most of the conventional equipment such as pumps and valves is not shown.

A whole crude is charged via line 10 to deasphalting means 20. Solvent circulation is conventional, and not shown, but will be mentioned briefly. A light, generally aliphatic solvent is added in amounts, and at conditions sufficient to reject or precipitate most of the asphalt and much or little of the resins. Solvent is recovered, either by flashing means, or solvent recovery columns within the deasphalting means 20, or may be recovered from various liquid fractions, e.g,. some or all of the solvent can be left with the deasphalted oil and eventually recovered from a downstream fractionation means and recycled.

The deasphalting means must produce an asphalt phase which is removed via line 26, and a deasphalted oil fraction (DAO) which is removed via line 22. A separate resin fraction may be recovered via line 24, or conditions within the deasphalting means 20 may be adjusted to that most of the resin is removed with the DAO in line 22.

DAO is charged via line 22 to heater 30, which may be a conventional crude column furnace, or may be operated at somewhat higher severity and perform some visbreaking. The DAO in line 22 is free of thermally unstable metal rich compounds, which were rejected with the asphalt. The DAO may be heated extensively without causing migration of metals into the distillable fractions recovered therefrom. The heated DAO is then charged via line 32 to distillation column 40 for recovery of conventional product fractions. The bottoms fraction is withdrawn via line 42 and may be mixed with one or more natively produced or imported solvent fractions and sent as a syncrude via pipeline to a remote refinery. In the embodiment shown, the heaviest fraction from the column 40 is recovered via line 42, and mixed with a resin fraction 24 and charged to an upgrading means 60 to produce a catalytically or thermally upgraded product via line 62. The upgrading may be catalytic, e.g., catalytic cracking or hydrotreating or hydrocracking, or thermal, e.g., visbreaking. Usually thermal processing such as visbreaking or coking will be preferred at remote sites.

The asphalt fraction produced via line 26, preferably after solvent recovery, will usually be burned in burner 50 to make steam. Boiler feed water is added via line 52 and heated to produce steam which is removed via line 54 usually for injection into the ground to produce more heavy oil, or to drive turbines. Some of the asphalt may also be burned as fuel in heater 30, or other heaters not shown.

The units can be relatively small size, skid mounted units with capacities perhaps as low as 10 barrels a day of whole crude at a remote site. Production from multiple wells can be gathered and treated in a larger central processing plant, having much higher capacity, usually in excess of 100 barrels per day.

FEEDSTOCKS

The feedstocks contemplated for use herein are whole crudes which contain a high proportion of residual oil, and preferably those heavy crudes which contain at least 50 wt % atmospheric resid. By this is meant that in a distillation operation conducted at atmospheric pressure, more than 50% of the feed to the distillation column would normally be recovered as a residual fraction, i.e., remain a liquid at atmospheric pressure at the column bottom temperature. Attempts to operate the distillation column at higher temperature would cause thermal cracking.

In conceptual terms, for purposes of understanding the present invention, the crude may be considered a complex mixture of hydrocarbons, most of which are thermally stable and some of which are not. Many discreet compounds that contain carbon, hydrogen and heteroatoms such a nitrogen, oxygen and sulfur upon heating do not undergo structural changes. In contrast, the asphaltenes undergo structural changes upon heating to temperatures encountered in many distillation columns. Thus most of the crude is thermally stable, while fractions of it, those fractions which contain the most metal, are not. The crude may be considered as containing three components:

1. light soluble components
2. maltenes
3. asphaltenes.

The soluble components include all of the light components of the crude, and the heavier components which are readily soluble in aliphatic solvents. Asphaltenes are generally insoluble in aliphatic solvents. The asphaltene fraction from a whole heavy crude will contain almost all of the metals, while the maltene fraction will have a greatly reduced metals content. The maltenes are somewhat soluble in aliphatic solvents, depending on deasphalting conditions.

The heavy crudes contemplated for use herein have very little light components boiling below 650 F, and an abundance of 650 F +material and asphaltenes.

In general terms, the whole crudes contemplated for use herein will have a 50 wt. % boiling point, at atmospheric pressure, in excess of 1000° F. Frequently, the 40%, or even th 30 volume % boiling point of such crudes will exceed 1000° F., i.e., be considered non-distillable.

The whole crudes contemplated for use herein must be asphaltenic in nature. Most heavy crudes are asphaltenic in nature and few are not. By asphaltenic in nature we mean a low API gravity of less than 30 for the whole crude and less than 20 API gravity for the 650 F +fraction. Asphaltic means a high proportion of naphthenic and aromatic compounds with low paraffin content.

These whole crudes would have a CCR content in excess of 10 wt %, a pentane insoluble asphaltene content of at least 10 wt % (using 10:1 pentane:oil). Many of the heavy crudes have a specific gravity above 0.9. The 650 F +fraction of some heavy crudes is so heavy that the specific gravity is above 1.0 (has an API gravity of less than 10) and would sink, rather than float, in water. More than 25% of the crude will have a boiling range above 1000 F.

The whole crudes contemplated for use in the present invention will contain large amounts of metals such as nickel and vanadium, much, and usually most of which, are coordinated by porphyrin or "porphyrin like" structures. These porphyrins, or "porphyrin like" structures, coordinate Ni and V, in complex aromatic structures that are asphaltic in nature. These porphyrins undergo degradation reactions which disrupt the aromaticity of the porphyrin rings and transform metal-coordinated porphyrin or metalloporphyrins into metal-coordinated polypyrrolic species. More details on such heavy crudes, and porphyrin degradation reactions, are provided in Degradation of Metalloporphyrins in Heavy Oils Before and During Processing, L. A. Rankel, Fossil Fuels Geochemistry, Characterization & Processing, ACS Symposium Series No. 344, Chapter 16, (ACS) 1987 ed. R. H. Filby and J. F. Branthaver, which is incorporated herein by reference.

As an example of the reactivity of the porphyrin, when an Arab Heavy crude is distilled to produce a vacuum resid, 90% of the petroporphyrins are degraded. It is believed that demetallation occurs through sequential hydrogenation of the peripheral double bonds, then by fragmentation of the ring and metal removal. H2S can also add to double bonds and may aid in ring saturation. FIG. 4. of the Ref. paper on Degradation of Metalloporphyrins presents some routes for porphyrin ring degradation by H2 or H2S. These degraded porphyrin species are more soluble in light hydrocarbons than the original porphyrin.

The net effect is that metals in the asphaltic fraction (Ni and V which are porphyrin coordinated), after thermal treatment change and are more soluble in lighter fractions, such as the gas oil and vacuum gas oil fractions. It is believed that the porphyrins, in the whole crude, are aromatic and like to stack, thereby increasing apparent molecular weight. See Porphyrins and Metalloporphyrins, Elsevier Scientific Publishing Co., H. Y. 1975, K. M. Smith editor, which is incorporated herein by reference. Once the porphyrin are thermally degraded, and the aromatic structure of the porphyrin disrupted by thermal treatment, stacking is no longer favored and increased solubility, and reduced apparent molecular weight occurs. Although we are confident that our conceptual model of metals rich heavy crudes is correct, it is not very helpful to a crude buyer or refinery designer, because standardized test methods have not yet been developed to measure porphyrin degradation during distillation. While visible spectroscopy can be used by an expert, in practice most crude oil buyers and refiners will rely on conventional crude assays, which only indirectly address porphyrin disruptability. The following guidelines can be given.

Typical levels of (Ni +V) in the whole crudes contemplated for use herein will exceed 50 wt ppm (total Ni +V), and frequently will exceed 100 or even 150 wt ppm (Ni +V).

There is no physical upper limit on metals concentrations contemplated for use herein. The present invention is most beneficial when exceedingly high metals levels are encountered in the whole crude, and when most or all of these metals are porphyrin coordinated, or coordinated by other polar molecules.

The heavy crudes usually contain relatively large amounts of sulfur and nitrogen. These are also concentrated in the heavier fractions of the crude, and are problems for downstream processing steps. However, the process of the present invention does not change sulfur and nitrogen partitioning, so sulfur and nitrogen concentrations are not an important consideration in applying the process of the present invention.

ATMOSPHERIC AND VACUUM DISTILLATION

All refineries use distillation to produce product fractions having a desired boiling range, either for use as products or for use as charge stocks to some other process. Typically whole crude is fractionated in an atmospheric tower to produce a gas oil (GO) fraction and a residual fraction which is not normally distillable at atmospheric pressure. This resid fraction is frequently charged to a vacuum distillation tower, to recover a vacuum gas oil (VGO) fraction and a vacuum resid.

In the past, refineries generated vacuum gas oils in the 850 -1000 F range. Modern vacuum towers are capable of high vacuum and/or operate with lower pressure drop though the tower and use more efficient column packing materials and produce vacuum gas oils with considerably more heavy material. Typical VGO cuts now include 850–1100 F boiling range material. This deeper cutting, or more rigorous fractionation produces larger yields of VGO, e.g., the 850–1100 F fraction of Maya crude is 18.0 wt %, while the 850–1000 F fraction is only 11.2 wt % of the whole crude. The 850–1100 F fraction contains large amounts of Ni +V while the lighter, 850–1000 F fraction contains almost no metals. The calculated yields and properties of these heavy gas oil fractions of Maya crude is presented in the following table:

TABLE A1

CALCULATED YIELDS AND PROPERTIES OF HEAVY GAS OILS

| | | | |
|---|---|---|---|
| TBP RANGE, F. | 750–850 | 850–1000 | 850–1100 |
| TBP RANGE, C. | 399–454 | 454–538 | 454–593 |
| YIELD, PCT WT CRUDE | 7.72 | 11.21 | 18.00 |
| YIELD, PCT VOL CRUDE | 7.69 | 10.85 | 17.00 |
| POSITION IN CRUDE, PCT WT | 41.80–49.52 | 49.52–60.73 | 49.52–67.52 |
| POSITION IN CRUDE, PCT VOL | 48.29–55.98 | 55.98–66.82 | 55.98–73.18 |
| MID PCT VOL | 52.13 | 61.40 | 64.58 |
| PROPERTIES | | | |
| GRAVITY, API | 21.1 | 17.1 | 15.1 |
| SPECIFIC GRAVITY, 60/60 F. | 0.9274 | 0.9525 | 0.9651 |
| SULFUR, PCT WT | 2.67 | 3.10 | 3.36 |
| NITROGEN, TOTAL, PPM | 1372. | | |
| BROMINE NUMBER | 4.4 | | |
| REFRACTIVE INDEX, 70 C. | 1.49747 | | |
| NEUT. NO., TOTAL ACID | 0.13 | | |
| CCR, PCT WT | 0.06 | 0.34 | 3.35 |
| NICKEL, PPM | 0.0 | 0.4 | 5.9 |
| VANADIUM, PPM | 0.0 | 3.0 | 50.7 |

When the 650 F +fraction contains lower levels of metals (ni+V), vacuum gas oil fractions such as 850–1100 F contain low metals levels. When a 650 F+ fraction is low in metals, less Ni+V is carried over into the 850–1100 F VGO. These metals in the VGO can be a problem in downstream FCC processing and are probably porphyrin- type coordinated Ni and V metals.

Results for Arab Light crude oil are presented below:

TABLE A2

| Fraction | Arab Light Crude Oil 650° F.+ | 750–850° F. | 850–1100° F. |
|---|---|---|---|
| wt % of crude | 58.6 | 7.3 | |
| ppm Ni | 6.7 | 0 | 0.3 |
| V | 26.6 | 0 | 1.4 |

It appears that about 5 to 10 % of the metals have been carried over in the vacuum distillation for Maya and Arab Light atmospheric resids.

DEASPHALTING PROCESS

Deasphalting is now used in many refiner asphaltics and metals from fractionated or thermally treated FCC feeds. Such conventional deasphalting will remove a large percentage of the Ni and V from the deasphalted oil (DAO). Such deasphalting is beneficial, but too late to achieve maximum removal of metals from GO and VGO fractions, because the thermal treatment, even mild thermal treatment associated with fractionation, converts some of the metal containing species into compounds which boil in, or dissolve in, the GO and VGO fractions.

In the process of the present invention, deasphalting is performed first, i.e., before any severe thermal treatment of the whole crude. Although deasphalting is essential for the practice of the present invention, the precise apparatus and operating conditions are not, per se, part of the present invention.

Any conventional deasphalting equipment and process can be used. Subcritical extraction, with hydrocarbon solvents mixed with one or more alcohols, et. may be used.

Most deasphalting processes use light aliphatic hydrocarbons such as propane, butane, pentane, etc. to precipitate asphaltenic components from the feed.

The "ROSE" or residual oil supercritical extraction process may be modified for use herein, although those modifications necessary to accommodate use of a whole crude as feed, rather than a resid fraction as feed, must be made.

Another approach to deasphalting is first to dissolve the whole crude in an aromatic solvent, then add an excess of aliphatic solvent to precipitate the asphaltenes.

In may be beneficial to deasphalt to precipitate not only the asphaltenes (containing the metal coordinated porphyrin) but also the maltenes. The precipitated fraction can then be given further treatment to resolve the maltenes from the asphaltenes. This approach, precipitating everything, or at least large amounts of maltenes and essentially all of the asphaltenes has some benefits. The initial yields of DAO will have a very low metal content, but will be lower in volume because much of the maltenes remains in the precipitated fraction. The precipitated material can be further treated, by another stage of solvent extraction, centrifugation, or any other equivalent means to recover maltenes. This should be done, however, without subjecting the maltene-asphaltenes to severe thermal treatment.

Such an approach (over precipitation, to remove both maltenes and asphaltenes) is conventional in heavy oil upgrading processes involving visbreaking of heavy crudes upstream of deasphalting. Further details of this approach are shown in U.S. Pat. No. 4,454,023, Lutz, Process for Upgrading a Heavy Viscous Hydrocarbon, which is incorporated herein by reference. Lutz used visbreaking, then distillation, then deasphalting to precipitate a resin fraction (roughly equivalent to our maltene fraction) and an asphaltene fraction. A separate resin fraction, which would be severely contaminated with metal, was recovered for recycle to the visbreaking zone.

The deasphalting conditions and equipment used in the U.S. Pat. No. 4,454,023 are similar to those suitable for use herein. The process of the present invention will actually have a slightly more difficult job deasphalting than that shown in U.S. Pat. No. 4,454,023. In '023 the severe thermal treatment additional thermal treatment (in the distillation column) may make it easier to deasphalt, because thermal treatment tends to make asphaltenes more aromatic because alkyl chains are cracked from these asphaltene molecules (the are visbroken to the point of sediment formation). The more aromatic asphaltene molecules remaining are thus somewhat easier to reject by solvent extraction.

Regardless of whether deasphalting proceeds directly, by adding an aliphatic solvent to the whole crude, or indirectly, by dissolving the crude in an aromatic solvent than adding an aliphatic solvent, the net result will be similar, namely that an asphaltenic fraction (which will contain the asphaltics and the coordinated metals) will be precipitated and separated from a maltene rich fraction. The maltene rich fraction may remain with, or be wholly or partially or totally returned to, the raffinate from deasphalting, to form a deasphalted whole crude (DWC). Although the maltene fraction may be isolated and separately upgraded, as discussed in a later portion of this specification, it usually will be preferred to keep together, or mix back together, the raffinate and maltenes to form deasphalted whole crude (DWC).

The deasphalted whole crude (DWC) may contain some of the deasphalting solvents, and will have a much reduced asphaltene and metals content. The DWC may safely be subjected to conventional thermal processing and/or solvent recovery steps, e.g., one or more stages of flash vaporization, distillation to recover solvent (for reuse in the deasphalting process) and to separate the DWC into various hydrocarbon fractions. The DWC will be substantially free of metal-coordinated porphyrins or metallo-porphyrins.

The asphalt fraction may be subjected to conventional stages of flash vaporization, distillation, etc. to recover solvents for reuse in deasphalting. The asphalt phase may be used as is (for making roads), mixed with water or other cutter stocks to make a low grade fuel oil, or coked to make more distillable product.

If these asphalt fractions are thermally treated and then distilled, or merely distilled at high temperature for solvent recovery, then the lighter products obtained therefrom may be severely contaminated with degraded porphyrin species, generated from the metallo-porphyrins during distillation. This phenomenon will be discussed in more detail under Thermal Treatment.

THERMAL TREATMENT

Thermal treatment, as used herein, refers to the amount of heating that a whole crude oil, or a fraction thereof, receives in conventional refinery processing. Surprisingly, thermal treatment can be conventional distillation to recover either a gas oil or a vacuum oil from a heavier fraction in a conventional distillation means. Severe thermal treatment prior to deasphalting should be avoided. Even after deasphalting, the asphaltic fraction should be processed gently, so that lighter fractions recovered from the asphalt are not contaminated with metals produced during thermal treatment associated with solvent or light ends recovery.

A useful concept for measuring the severity of any thermal process is ERT seconds or equivalent reaction time at 800° F. It was a concept originally developed for early thermal processes such as visbreaking or thermal cracking to permit comparing the severity of one unit operating at a relatively high temperature for a relatively short time to another unit operating at a lower temperature for a longer time. The ERT concept is well known in the industry, and in text books and discussed at greater length by T. Y. Yan - Petroleum Division, ACS Preprint, Vol 32, #2, P. 490, April 1987, which is incorporated herein by reference.

The following section shows the threshold severity of the thermal treatment to cause a breakdown of metalloporphyrins in many heavy crudes to more soluble, lower boiling species, is about 10 ERT, with more significant breakdown occurring at 20 ERT seconds. Most metalloporphyrin type compounds breakdown when subjected to thermal processing in excess of 30 to 40 ERT seconds, and few survive treatments in excess of 50 ERT seconds.

The thermal exposure, or ERT, experienced by the asphaltic fraction of a heavy crude in going through a conventional main distillation column is typically 2 to 40 ERT seconds, and in a vacuum distillation column is about 10 to 80 ERT seconds. Almost always the thermal treatments are additive, i.e., the crude goes first through the main column, and then the residual fraction from that column is charged to the vacuum column, so that a typical VGO will experience, e.g., 15 ERT seconds (main column) plus another 30 ERT seconds (vacuum column), for a total thermal processing of 45 ERT seconds.

In general, the heavier the crude the more severe the thermal treatment, i.e., the whole crude will first be topped, then fractionated in a main column to produce a residual fraction, and this residual fraction given further distillation in a vacuum tower to produce a vacuum resid bottom fraction.

We prefer to avoid all distillation of whole crude, but can tolerate some fractionation (thermal processing) provided that ERT is minimized. Thus a modest amount of topping, or removal of naphtha and lighter material can usually be tolerated without too much adverse effect. It may even be possible to achieve some measure of conventional fractionation, in a tower designed to operate with short residence time for liquid fractions, or designed to operate at much lower pressures than normal so that temperatures in the tower can be reduced.

Although we do not wish to be bound by any theory, we believe that thermal processing is bad because it produces some asphaltene and some maltene conversion, which is discussed at greater length hereafter.

ASPHALTENE/MALTENE CONVERSION

The most significant thermally induced reaction is degradation of metalloporphyrins. These metal rich species suffer an apparent reduction in molecular weight (due to their reduced stacking tendency after thermal treatment), so that they are recovered with gas oil and vacuum gas oil fractions. Other adverse, thermally induced reactions are also believed to occur.

Even mild thermal treatment can produce some visbreaking. This visbreaking decreases the maltene viscosity and increases the solvent power of maltenes. This promotes dissolution of asphaltenes and other metal-containing species in lighter fractions and makes it easier for metal compounds to dissolve in fractions such as the gas oil and vacuum gas oil fractions.

Maltenes also crack, polymerize and condense to produce asphaltenes during mild thermal treatment. Maltenes can be catalytically upgraded, if they are separated from the asphaltene fraction prior to thermal treatment. This reduced conversion of maltenes to asphalt is an important benefit, but not as easy to see as reduced metals content of gas oil and VGO fractions. It is hard to analyze and material balance the asphaltic fractions, while comparatively easy to run a metals material balance. Thus reduced conversion of maltenes to asphalt is believed to be real, and a significant benefit, but hard to document in a laboratory. •

PRODUCTION OF NAPHTHENIC OILS

Naphthenic oils are highly regarded for lubricants, but are becoming increasingly difficult to find. We discovered that one of the worst crudes from a lube stock standpoint, provides a maltene fraction which can readily be upgraded to a high grade naphthenic lubricant.

Several upgrading routes are possible. When a relatively asphaltene free maltene fraction is available (e.g., a two stage solvent deasphalting process like that in U.S. Pat. No. 4,454,023 is used to produce an asphaltene free "resin") conventional hydrogenation technology is easy to use. Such resin fractions are relatively free of metals and asphaltenes, and conventional hydrotreating or hydrocracking catalysts, preferably operated at relatively high hydrogen partial pressures, in excess of 500 psi, can be used to produce a "synthetic" naphthenic crude. This crude can be processed using conventional lube processing technology to make naphthenic lube stocks.

When a mixture of maltenes and asphaltenes, or just an asphaltene fraction is to be upgraded, similar, but more robust, hydrogenation technology can be used to hydrogenate the material into a synthetic naphthenic crude. The presence of the asphaltenes, and the high metals content, means that considerably more expensive upgrading technology must be used. Expanded bed hydroprocessing ("LC-Fining") or use of various proprietary hydrotreating and/or hydrocracking catalysts which are metals tolerant can be used to add hydrogen to asphaltene containing mixtures and produced demetallized products from which naphthenic lubricant stocks can be extracted. As an example, asphaltenes may be dissolved in an aromatic solvent, then hydrodemetallized over a Co-Mo alumina catalyst to give a hydrogenated, heavy distillate with a low metals content.

Because of the remoteness of most of the sources of heavy oil, and the difficulty of transporting such materials, it will usually be preferred to simply burn the asphalt fraction to make steam to produce more heavy oil, or use the low quality asphalt to make roads. The asphaltics could also be coked, or sulfonated and used in tertiary oil recovery.

EXAMPLE 1

This example shows that even the mild thermal process needed to recover lighter products from an atmospheric resid (650° F.+boiling material) causes metals to, in effect, migrate up from the asphaltene fraction into lighter fractions of the crude.

The first part of the experiment involved pentane deasphalting of Mayan crude. 14.2% asphaltenes were precipitated to produce a deasphalted oil containing 9.1 ppm nickel and 45.6 ppm vanadium. It is believed that all the metal in the feed is in the 1050° F.+fraction of Mayan 650° F.+fraction.

The metals concentration calculations are reported after Table 1, but the important thing to note is that based on these assumptions, the 650° F+Mayan resid would be expected to contain, after deasphalting, 90.4 ppm (Ni+V).

As can be seen in Table 1, the 650° F.+resid actually contains a $C_5$ soluble fraction metals content of 99.7 ppm (NI+V), about 10% more metal than expected.

TABLE II

DEASPHALTING MAYA CRUDE AND MAYA ATMOSPHERIC RESID

| | Mayan Crude | 650° F.+ |
|---|---|---|
| C wt % | 82.1 | |
| H wt % | 10.7 | |
| N wt % | .34 | |
| S wt % | 3.25 | 4.42 |
| Ni ppm | 52 | 83 |
| V ppm | 280 | 413 |
| IBP–420 F. | 14.5 | |
| 420–650 F. | 17.0 | |
| 650–850 F. | 7.5 | |
| 850 F.+ | 61.0 | |
| 1050 F.+ | 35.7% | 59% |
| CCR wt % | 7.82 | 15.3 |
| % C5 Insoluble | 14.2 | 25.2 |
| $C_5$ Soluble | | |
| Ni ppm | 9.1 | 23.0 |
| V ppm | 45.6 | 75.8 |
| (Ni + V) | 54.7 | 99.7 |

ESTIMATED (Ni +V)

Using the above, and other experimental results, it is possible to estimate the metal content of gas oil and VGO fractions of the deasphalted whole Maya crude. The gas oil and VGO fractions are of interest because they are readily upgraded in FCC units, where metals contamination is a severe problem.

Three cases were considered:

I. Atmospheric distillation, then vacuum distillation.

II. Atmospheric distillation, then pentane deasphalting to produce DAO, then vacuum distillation of the DAO.

III. (invention) Pentane deasphalting of whole crude, then atmospheric distillation then vacuum distillation.

In each case the boiling ranges of the feed fractions are the same, i.e., gas oil fractions comprise material boiling in the range of 750–850 F, while all the VGO fractions boil in the range of 850–1100 F.

TABLE III

ESTIMATED (Ni + V) OF FCC FEED FRACTIONS

| Fraction | Wt % of Crude | ppm Ni | ppm V |
|---|---|---|---|
| I: Gas Oil | 7.7 | 0 | 0 |
| I: VGO | 18.0 | 5.9 | 50.7 |
| II: VGO | 18.0 | 1.8 | 9.0 |

TABLE III-continued

ESTIMATED (Ni + V) OF FCC FEED FRACTIONS

| Fraction | Wt % of Crude | ppm Ni | ppm V |
|---|---|---|---|
| III: VGO | 18.0 | 1.1 | 9.0 |

The above estimate shows that a significant reduction in Ni content of VGO from a Maya crude can be achieved by deasphalting whole crude before atmospheric and vacuum distillation. In most FCC units Ni is a more severe problem than V, and the estimated reduction in Ni content due to the practice of the present invention would significantly reduce the need for makeup catalyst to control Ni level on equilibrium cracking catalyst.

EXAMPLE 2

Thermal Sensitivity of Petroporphyrins

In this experiment an Arab heavy crude:

| Arabian Heavy Crude | |
|---|---|
| % C | 83.3 |
| % H | 11.8 |
| % N | 0.16 |
| % O | <0.1 |
| % S | 2.89 |
| Ni, ppm | 19 |
| V, ppm | 57 |
| % $C_5$-insolubles | 7.3 |
| B.P. Distribution | |
| IBP–420° F. | 16.8 |
| 420–650 | 18.8 |
| 650–850 | 16.6 |
| 850° F.+ | 47.8 |

is thermally treated in a tubular reactor and the amount of petroporphyrins measured before and after treatment. The feed contained 400 μg P/g oil, where P=petroporphyrins.

Thermal Treatment of Arabian Heavy Crude

Run in ⅝ in tubular reactor (15 cc/vol):

Reactor Packing: Vycor 12/20 mesh sized; Flow: 100 cc/min

| Run Number | Feed | 1 |
|---|---|---|
| Reaction temp., °F. | | 752 |
| LHSV (hrs.$^{-1}$) | | 2 (420 ERT) or less) |
| Reactor packing | | Vycor |
| Gas used | | He |
| Pressure, psig | | 500 |
| μg P/g oil | 400 | 44.4 P = petroporphyrins |
| % Oxygen in oil | >0.1 | 0.84 |

Here we see that about 90% of the petroporphyrins are degraded by a heat treatment similar to a distillation unit in a refinery.

Commercial Significance

The process of the present invention provides a way to reduce the metals content of distillable products obtained from heavy crudes by simply reversing conventional processing steps. There is very little penalty associated with deasphalting these whole crudes first, then distilling, and the benefit of reduced metals contamination of lighter products is significant. With hydrotreating, the present invention can produce naphthenic crudes and lubricating stocks from very poor quality crudes.

We claim:

1. A process for recovering distilled hydocarbon product from a whole asphaltic crude comprising at least 40 volume % non-distillable residue at distillation conditions and thermally unstable, high boiling, metal containing compounds present in said non-distillable residue comprising (a) deasphalting the asphaltic crude in a deasphalting means to produce a deasphalted oil with a reduced asphalt content relative to the feed and wherein the whole crude is deasphalted by contact with an aromatic solvent, then contacted with an aliphatic solvent to precipitate asphalt components, (b) heating the deasphalted crude to a temperature in excess of 500° F. in a downstream refinery process.

2. The process of claim 1 wherein the deasphalted crude is distilled to produce hydorcarbon fractions comprising at least one of gas oil and vacuum gas oil boiling range steams.

3. The process of claim 1 wherein the deasphalting means produces separate maltene and asphaltene fractions.

4. The process of claim 1 wherein the unstable metal containing compounds comprise Ni and V compounds.

5. The process of claim 1 wherein from 10 to 100% of the unstable metal containing compounds are coordinated organometallic species which are soluble in the whole crude and in polar solvents.

6. The process of claim 5 wherein at least a majority of the unstable metal compounds are porphyrin coordinated.

7. A process for preparing an FCC feed from an asphaltic whole crude comprising gas oil and/or vacuum oil fractions, and at least 50 volume % nondistillable residue at distillation conditions including a temperature above 500 F, and having more than 20 ppm nickel and 20 ppm vanadium in the form of thermally unstable, high boiling Ni and V containing compounds in said residue fraction, comprising:

deasphalting the asphaltic whole crude in a deasphalting means by contact with an aromtic solvent, then contact with an alipahtic solvent to precipitate asphalt components, to produce a easphalted crude having a reduced asphaltic content and less than 50% of the thermally unstable Ni and V compounds; and distilling the deasphalted whole crude to produce at least one hydrocarbon fraction boiling in the gas oil or vacuum gas oil range as said FCC feed.

8. The process of claim 7 wherein the deasphalting means produces separate maltene and asphaltene fractions and the maltene fraction is added to feed to the catalytic cracking unit.

9. The process of claim 7 wherein from 50 to 100% of the unstable Ni and V compounds are coordinated organometallic species which are soluble in whole crude and polar solvents.

10. The process of claim 9 wherein at least a majority of the Ni and V compounds are porphyrin coordinated.

11. The process of claim 9 wherein at least a majority of the Ni and V compounds are in a porphyrin-type coordination.

* * * * *

UNITED STATES PATENT AND TRADEMARK OFFICE

CERTIFICATE OF CORRECTION

PATENT NO. : 5,192,421

DATED : Mar. 9, 1993

INVENTOR(S) : Costandi A. Audeh et al

It is certified that error appears in the above-indentified patent and that said Letters Patent is hereby corrected as shown below:

Col. 15, Line 5, claim 1: After "conditions" and before "and" insert --including a temperature above 500°F--

Col. 15, Line 8, claim 1: After "asphaltic" and before "crude" insert --whole--

Col. 15, Line 14, claim 1: Delete "heating" and replace with --distilling--

Col. 15, Line 14, claim 1: After "deasphalted" and before "crude" insert --whole--

Col. 15, Line 14, claim 1: Delete "to" and replace with --at--

Signed and Sealed this

Twenty-second Day of February, 1994

*Attest:*

Bruce Lehman

BRUCE LEHMAN

*Attesting Officer*

*Commissioner of Patents and Trademarks*